US005293016A

United States Patent [19]

Nar

[11] Patent Number: 5,293,016

[45] Date of Patent: Mar. 8, 1994

[54] CIRCUIT BREAKER

[75] Inventor: Ramesh G. Nar, Cambridge, Md.

[73] Assignee: North American Philips Corporation, New York, N.Y.

[21] Appl. No.: 82,323

[22] Filed: Jun. 24, 1993

Related U.S. Application Data

[63] Continuation of Ser. No. 535,804, Jun. 11, 1990, abandoned.

[51] Int. Cl.[5] ..... H01H 5/00

[52] U.S. Cl. ..... 200/401; 200/400

[58] Field of Search ..... 200/400, 401, 323, 324, 200/325; 335/140, 167, 168, 169, 170, 171, 172, 173, 174, 10

[56] References Cited

U.S. PATENT DOCUMENTS

| | | | |
|---|---|---|---|
| 2,390,735 | 12/1945 | Pokorny | 335/21 |
| 3,329,913 | 7/1967 | Camp | 335/38 |
| 3,484,726 | 12/1969 | Strobel | 335/173 |
| 3,731,239 | 5/1973 | Ellenberger | 335/167 |
| 3,786,380 | 1/1974 | Harper | 335/9 |
| 3,806,848 | 4/1974 | Harper et al. | 335/188 |
| 4,117,285 | 8/1978 | Harper | 200/293 |

OTHER PUBLICATIONS

Search Report Aug. 28, 1992.

*Primary Examiner*—Henry J. Recla
*Assistant Examiner*—David J. Walczak
*Attorney, Agent, or Firm*—David R. Treacy

[57] ABSTRACT

A circuit breaker is disclosed having a toggle mechanism in which a desired overlap between the cam link and the sear pin is conveniently, and automatically, achieved. The toggle mechanism also exhibits a relatively small eccentricity, resulting in a circuit breaker which is significantly more sensitive to overcurrents than previous such circuit breakers.

18 Claims, 6 Drawing Sheets

CIRCUIT BREAKER

This is a continuation of application Ser. No. 07/535/804, filed Jun. 11, 1990 now abandoned.

BACKGROUND OF THE INVENTION

1. Field of the Invention

The invention pertains generally to circuit breakers.

2. Description of the Related Art

A single pole circuit breaker is a device which serves to interrupt electrical current flow in an electrical circuit path upon the occurrence of an overcurrent in the circuit path. On the other hand, a multipole circuit breaker is a device which includes two or more interconnected, single pole circuit breakers which serve to substantially simultaneously interrupt current flow in two or more circuit paths upon the occurrence of an overcurrent in any one circuit path.

An exemplary, conventional single pole circuit breaker is depicted in FIGS. 1, 2A and 2B. As shown, the single pole circuit breaker 10 includes an electrically insulating casing 20 which houses, among other things, stationarily mounted terminals 30 and 40. In use, these terminals are electrically connected to the ends of the electrical circuit which is to be protected against overcurrents.

As is known, the casing 20 also houses a stationary electrical contact 50 mounted on the terminal 40 and an electrical contact 60 mounted on a contact bar 70. Significantly, the contact bar 70 is pivotably connected via a pivot pin 80 to a stationarily mounted frame 100. A helical spring 85, which encircles the pivot pin 80, pivotally biases the contact bar 70 toward the frame 100. A contact bar stop pin 90, mounted on the contact bar 70, limits the pivotal motion of the contact bar relative to the frame. By virtue of the pivotal motion of the contact bar 70, the contact 60 is readily moved into and out of electrical contact with the stationary contact 50.

An electrical coil 110, which encircles a magnetic core 120 topped by a pole piece 130, is positioned adjacent the frame 100. An electrical braid 140 serves to electrically connect the terminal 30 to one end of the coil 110. An electrical braid 150 connects the opposite end of the coil 110 to the contact bar 70. Thus, when the contact bar 70 is pivoted in the clockwise direction (as viewed in FIG. 1), against the biasing force exerted by the spring 85, to bring the contact 60 into electrical contact with the contact 50, a continuous electrical path extends between the terminals 30 and 40.

The circuit breaker 10 also includes a handle 160 which is pivotably connected to the frame 100 via a pin 170. In addition, a toggle mechanism is provided, which connects the handle 160 to the contact bar 70. As more clearly depicted in FIG. 2A, this toggle mechanism includes a cam link 190 which is pivotably connected to the handle 160 via a pin 180. A significant feature of the cam link 190, shown in expanded view in FIG. 2B, is the presence of a step, formed by the intersection of nonparallel surfaces 194 and 198, in the outer profile of the cam link 190.

With further reference to FIGS. 2A and 2B, the toggle mechanism of the circuit breaker 10 also includes a link housing 200, to which is connected a projecting arm 205. The link housing is pivotably connected to the cam link 190 by a rivet 210 and pivotably connected to the contact bar 70 by a pin 220.

The toggle mechanism further includes a sear assembly, including a sear pin 230 which extends through an aperture in the link housing 200 to the cam link 190. This sear pin includes a circularly curved surface 232 (see FIG. 2B) which is intersected by a substantially planar surface 233. The sear assembly also includes a leg 235 (see FIG. 2A), connected to the sear pin 230, and a sear striker bar 240, which is connected to the leg 235 and projects into the plane of the paper, as viewed in FIG. 2A. A helical spring 250, which encircles the sear pin 230, pivotally biases the leg 235 of the sear assembly into contact with the leg 205 of the link housing 200. As a consequence, the sear pin 230 engages the step in the cam link 190, i.e., a portion of the surface 194 of the cam link 190 overlaps and contacts a portion of the curved surface 232 of the sear pin 230. Significantly, it is by virtue of this engagement that the toggle mechanism is locked and thus capable of opposing and counteracting the pivotal biasing force exerted by the spring 85 on the contact bar 70, thereby maintaining the electrical connection between the contacts 50 and 60.

By manually pivoting the handle 160 in the counterclockwise direction (as viewed in FIG. 1), the toggle mechanism, while remaining locked, is translated and rotated out of alignment with the pivotal biasing force exerted by the spring 85 on the contact bar 70. This biasing force then pivots the contact bar 70 in the counterclockwise direction, toward the frame 100, resulting in the electrical connection between the contacts 50 and 60 being broken. Manually pivoting the handle 160 in the clockwise direction then serves to reverse the process.

As shown in FIG. 1, the single pole circuit breaker 10 also includes an armature 260, pivotably connected to the frame 100. This armature includes a leg 265 which is positioned adjacent the sear striker bar 240. In the event of an overcurrent in the circuit to be protected, this overcurrent will necessarily also flow through the coil 110, producing a magnetic force which induces the armature 260 to pivot toward the pole piece 130. As a consequence, the armature leg 265 will strike the sear striker bar 240, pivoting the sear pin 230 out of engagement with the step in the cam link 190, thereby collapsing the toggle mechanism. In the absence of the opposing force exerted by the toggle mechanism, the biasing force exerted by the spring 85 on the contact bar 70 will pivot the contact bar in the counterclockwise direction, toward the frame 100, resulting in the electrical connection between the contacts 50 and 60 being broken.

Two or more single pole circuit breakers 10 are readily interconnected to form a multipole circuit breaker. In this configuration, each such single pole circuit breaker 10 further includes, as depicted in FIG. 3, a trip lever 270 which is pivotably connected to the frame 100 via a pivot pin 320. The trip lever 270 is generally U-shaped and includes arms 280 (shown in FIG. 3) and 290 (not shown in FIG. 3) which at least partially enfold the frame 100. A helical spring 330, positioned between the frame 100 and the arm 280 and encircling the pin 320, pivotally biases the trip lever toward the frame 100. A projection 300 of the trip lever 270, which, as viewed in FIG. 3, projects out of the plane of the paper, is intended for insertion into a corresponding aperture in the trip lever of an adjacent single pole circuit breaker. Thus, any pivotal motion imparted to the trip lever 270, in opposition to the biasing force exerted by the spring 330, is transmitted to the adjacent trip lever, and vice versa.

In the operation of the single pole circuit breaker 10, when employed in a multipole circuit breaker, if an overcurrent flows through the coil 110, then, as a result, as described above, the single pole circuit breaker 10 will be tripped, i.e., the contact bar 70 will be pivoted in the counterclockwise direction and the electrical connection between the contacts 50 and 60 will be broken. During this pivoting motion, the pin 220, pivotably connecting the link housing 200 to the contact bar 70, will engage a camming surface 285 on the bottom of the arm 280, thereby applying a torque to the trip lever 270. Consequently, the trip lever 270 will be pivoted away from the frame 100 and toward the armature 260. This pivotal motion will also be imparted to the trip lever of the adjacent single pole circuit breaker via the projection 300. Provided the torque applied by the pin 220 is sufficiently large, then the trip lever of the adjacent single pole circuit breaker will depress the corresponding armature, thereby tripping the adjacent single pole circuit breaker.

While single pole circuit breakers of the type described above are definitely useful, there are certain difficulties associated with their manufacture. For example, as more readily understood with reference again to FIGS. 2A and 2B, one such difficulty is associated with achieving an appropriate amount of overlap between the surface 194 of the cam link 190 and the curved surface 232 of the sear pin 230, when the toggle mechanism is in the locked position. As is known, the minimum amount of overlap is dictated by the need to prevent the toggle mechanism from collapsing in the absence of an overcurrent, if the circuit breaker is merely mechanically vibrated. On the other hand, the maximum amount of overlap is dictated by the requirement that the toggle mechanism collapse, upon the occurrence of an overcurrent, no later than the instant the armature 260 strikes the pole piece 130. In fact, it is generally desirable that collapse occur as the armature 260 pivots toward the pole piece 130 but before it actually impacts the pole piece. This is due to the fact that if the overlap is chosen so that collapse occurs only at the point of impact, then manufacturing variability may result in overlaps which are slightly larger than desired, and in corresponding toggle mechanisms which do not collapse even at the point of impact.

Conventionally, to achieve an appropriate amount of overlap., the depth of the step, i.e., the length of the surface 194, of the cam link 190 is made significantly greater than the desired overlap. In addition, during the process of assembling the toggle mechanism, an assembly-line worker bends the leg 205 of the link housing 200 to different test positions, resulting in the biasing spring 250 rotating the curved surface 232 of the sear pin 230 into different overlaps with the surface 194. At each test, position, a shim of specified thickness is inserted between the leg 235 of the sear assembly and the arm 205 of the link housing, which is intended to cause toggle collapse. Once collapse occurs, the correct amount of overlap is assumed to have been achieved. This procedure is also repeated after assembly of the circuit breaker as a whole. The resulting length of the overlap, expressed as a percentage of the length of the surface 194, is, at most, 75 percent, and usually significantly less than 75 percent.

Obviously, the current procedure for achieving appropriate amounts of overlap is time-consuming, requires manual labor and, as a consequence, significantly adds to the cost of manufacturing and assembling circuit breakers.

Yet another difficulty associated with the manufacture of conventional circuit breakers is that of achieving uniform eccentricities. That is, when the toggle mechanism of the circuit breaker 10 is in the locked position, as depicted in FIG. 2A, and an imaginary, straight line 215 is drawn from the center of the pivot pin 180 to the center of the pivot pin 220, then the center of the rivet 210, which pivotably connects the cam link 190 to the link housing 200, should be to the right (as viewed in FIG. 2A) of the imaginary line 215. (If the center of the rivet 210 were to the left of the imaginary straight line 215, then rotating the sear pin 230 out of engagement with the step in the cam link 190 would not lead to the collapse of the toggle mechanism.) The length of a perpendicular 217 extending from the imaginary line 215 to the center of the rivet 210 is defined as the eccentricity of the toggle mechanism. Significantly, the magnitude of the force that must be applied to the sear striker bar 240 to collapse the toggle mechanism is determined by the eccentricity, i.e., the larger the eccentricity, the larger the force, and vice versa.

If the toggle mechanism is initially in the collapsed position, then pivoting the handle 160 in the clockwise direction (as viewed in FIG. 1) will produce translation and rotation of the toggle mechanism components into the locked position, shown in FIG. 2A. In particular, during this translation and rotation, the cam link 190 initially undergoes a relatively small amount of rotation about the rivet 210 in the clockwise direction (as viewed in FIG. 2A) until the back of the cam link 190 contacts the inner surface of the link housing 200. The length of the perpendicular 217 relative to the line 215, at the point when the cam link 190 achieves its maximum clockwise rotation, is here termed the baseline eccentricity, which is largely determined by the basic geometry of the circuit breaker configuration. After reaching its position of maximum clockwise rotation, the cam link 190 undergoes counterclockwise rotation about the rivet 210 until the surface 194 of the cam link 190 contacts the curved surface 232 of the sear pin 230, thereby locking the toggle mechanism. As a result of this counterclockwise rotation, the baseline eccentricity is increased by an amount here termed the supplemental eccentricity, to arrive at the eccentricity, as defined above. But the amount of counterclockwise rotation is related to the initial amount of clockwise rotation, which is limited by the distance between the back of the cam link 190 and the inner surface of the link housing 200. However, the link housing 200 is formed by bending sheet metal, a relatively imprecise process which introduces considerable variability into the distance between the back of the cam link 190 and the inner surface of the link housing 200, and a corresponding variability into the supplemental eccentricity, and thus into the eccentricity.

To minimize the eccentricity variability, described above, and thereby achieve uniformity of circuit breaker operation, it has been necessary to employ relatively large baseline eccentricities, which has led to relatively large eccentricities. However, the use of these relatively large eccentricities has led to toggle mechanisms which must be impacted by relatively large forces to achieve toggle collapse. Unfortunately, this implies that the corresponding circuit breakers are relatively insensitive to overcurrents.

To achieve meaningful comparisons of the eccentricities employed in circuit breakers having different physical dimensions, it is generally more useful to compare values of the ratio of the length of the imaginary straight line 215 to the corresponding eccentricity, a non-dimensional number hereinafter denoted R. Clearly, the smaller the eccentricity, the larger the value of R, and vice versa. Because of the need to employ relatively large values of eccentricity in conventional circuit breakers, as discussed above, the corresponding values of R have been limited to no more than about 47. Clearly, larger values of R, resulting from smaller eccentricities, are desirable as this would lead to circuit breakers which are more sensitive to overcurrents.

Thus, those engaged in developing circuit breakers have sought, thus far unsuccessfully, circuit breakers in which desired overlaps are more conveniently achieved, and which exhibit relatively large values of R.

SUMMARY OF THE INVENTION

The invention involves a circuit breaker having a toggle mechanism in which a desired overlap between the cam link and the sear pin is conveniently, and automatically, achieved. Moreover, this toggle mechanism is capable of achieving values of R which are substantially larger than was previously possible.

In accordance with the invention, a desired overlap is achieved by forming the step in the surface of the cam link with a depth which is preferably essentially equal to the desired overlap. In addition, a helical spring is provided, encircling the sear pin, which pivotally biases the substantially planar surface of the sear pin into contact with the bottom of the step in the cam link, thereby automatically achieving the desired overlap. As a consequence, the length of the overlap, expressed as a percentage of the depth of the step, is invariably greater than about 75 percent, and usually essentially equal to 100 percent.

The toggle mechanism of the inventive circuit breaker achieves significantly smaller values of eccentricity, and correspondingly larger values of R, by not relying on the inner surface of the link housing to limit the initial clockwise rotation of the cam link. Rather, in accordance with the invention, this rotation is limited by forming a hook in the outer profile of the cam link, at a distance from the step, which partially encircles, and is capable of frictionally engaging, the sear pin. In addition, the distance from the step to the hook is intentionally made slightly larger than the cross-sectional dimension, e.g., the diameter, of the sear pin. This dimensional difference determines the amount of clockwise rotation the cam link undergoes before this rotation is stopped by frictional engagement between the hook and the sear pin. Because the processes conventionally employed in manufacturing the cam link and sear pin, e.g., conventional powder pressing and machining techniques, yield parts having relatively precise dimensions, with relatively small variability between parts, the amount of clockwise rotation, and therefore the amount of counterclockwise rotation, which the cam link undergoes is precisely controlled, with relatively small variability between different toggle mechanisms. As a consequence, significantly smaller baseline eccentricities, and therefore significantly smaller eccentricities, can now be employed, which leads to values of R which are equal to or greater than about 50, preferably equal to or greater than about 60, and more preferably equal to or greater than about 70. In this regard, in one particular reduction to practice, a value of R equal to 70.7 was readily achieved.

BRIEF DESCRIPTION OF THE DRAWINGS

The invention is described with reference to the accompanying drawings, wherein.

DETAILED DESCRIPTION OF THE PREFERRED EMBODIMENTS

The invention involves a circuit breaker having a toggle mechanism in which a desired overlap between the cam link and the sear pin is conveniently and automatically achieved. In addition, the toggle mechanism achieves much smaller values of eccentricity, and correspondingly larger values of R, than was previously possible.

Figure 1:
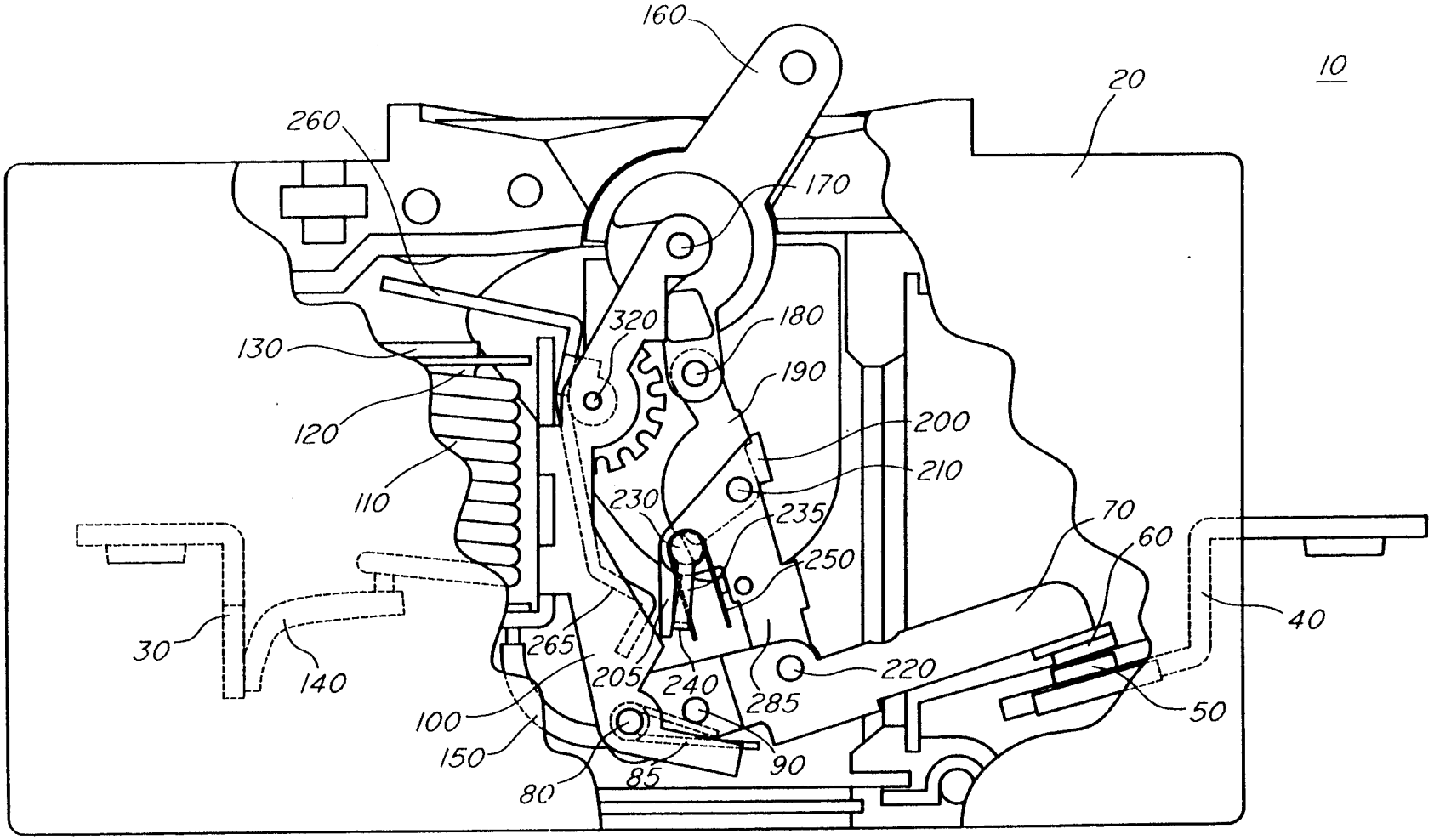
FIGURE 1 PRIOR ART
FIG. 1 is a view of the mechanism of a conventional single pole circuit breaker.
Figures 2A, 2B:
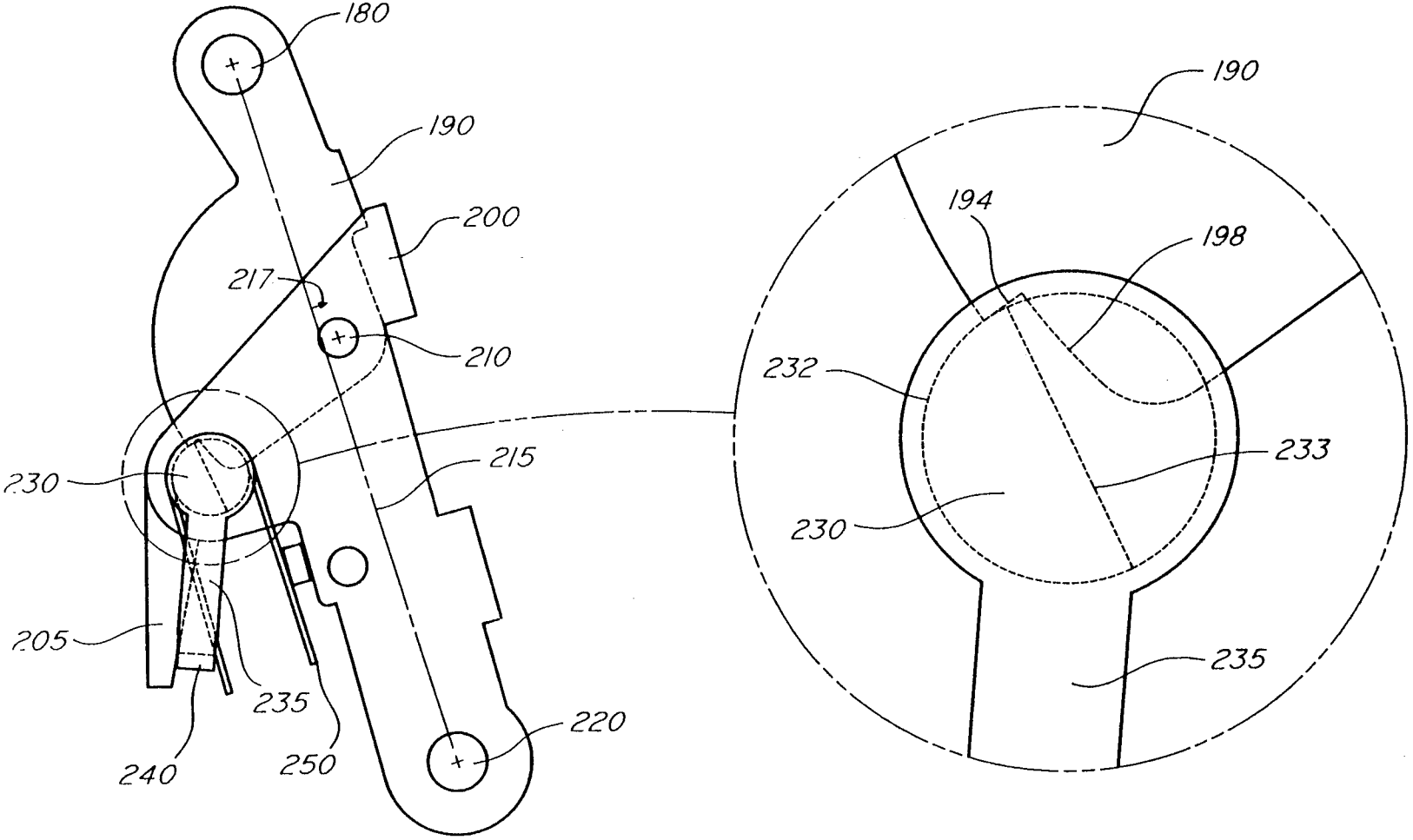
FIGURE 2B PRIOR ART
FIGURE 2A PRIOR ART
FIG. 2A depicts the toggle mechanism of the single pole circuit breaker of FIG. 1.
FIG. 2B is an expanded view of a portion of FIG. 2A.
Figure 3:
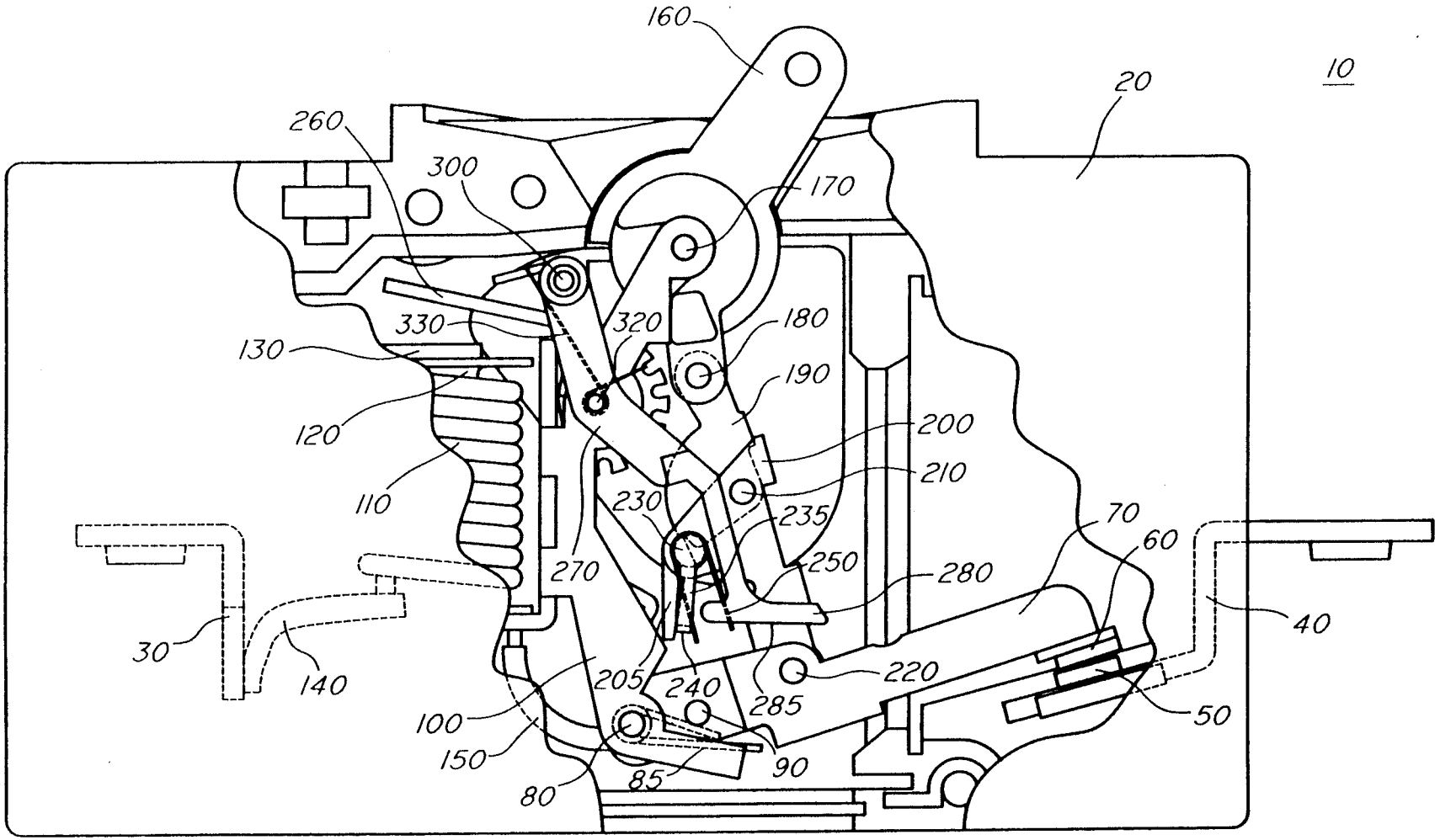
FIGURE 3 PRIOR ART
FIG. 3 is a view of the mechanism of the single pole circuit breaker of FIG. 1, modified to include a trip lever for use in a multipole circuit breaker.
Figure 4:
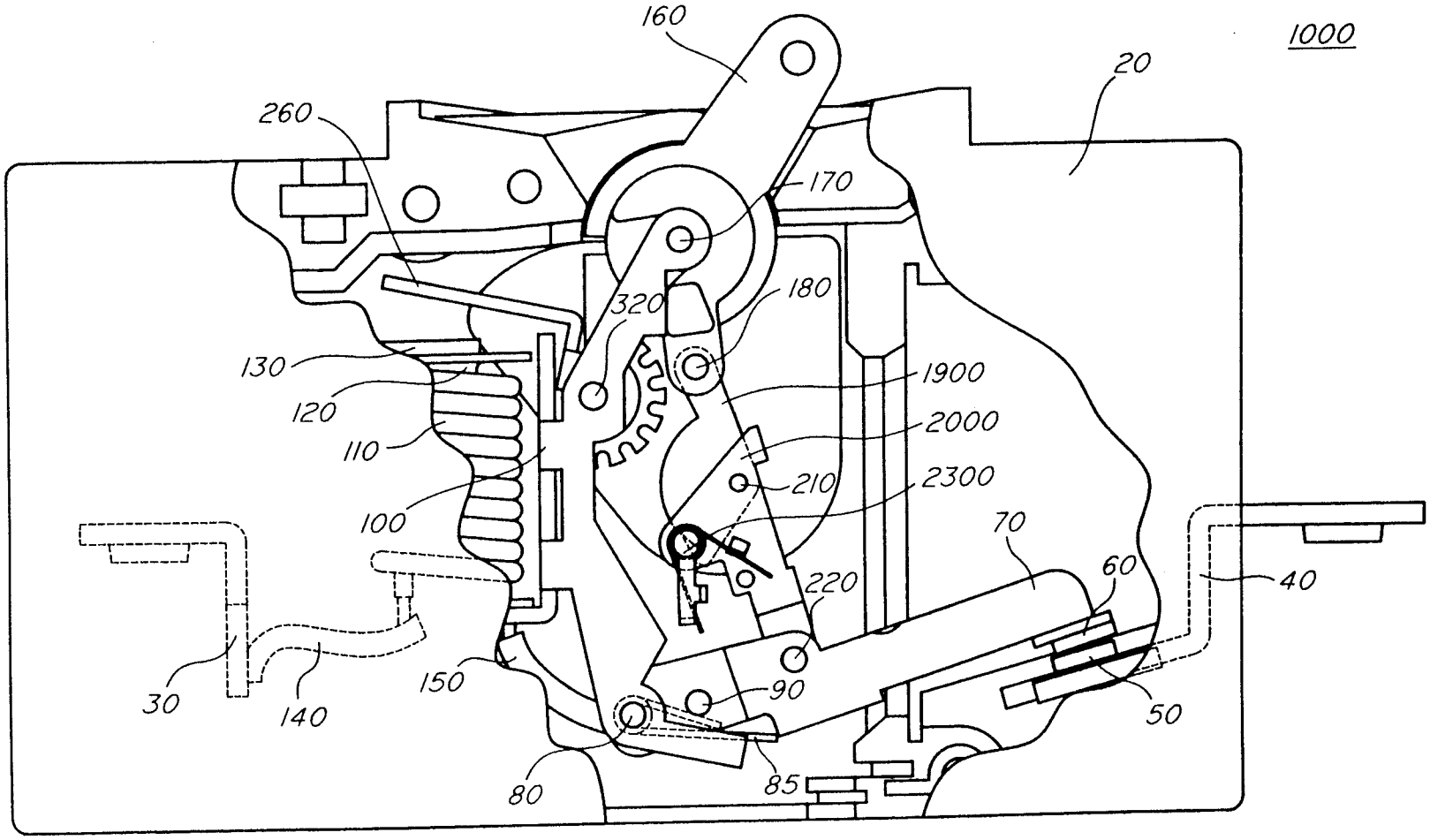
FIG. 4 is a view of the mechanism of the inventive single pole circuit breaker.

With reference to FIG. 4, the inventive single pole circuit breaker 1000 is generally similar to the conventional single pole circuit breaker 10 depicted in FIG. 1, with like parts being denoted by like numerals. However, the toggle mechanism of the inventive circuit breaker 1000 includes a number of innovations, these being highlighted through the use of new numerals in identifying the toggle mechanism components.

Figure 5B:
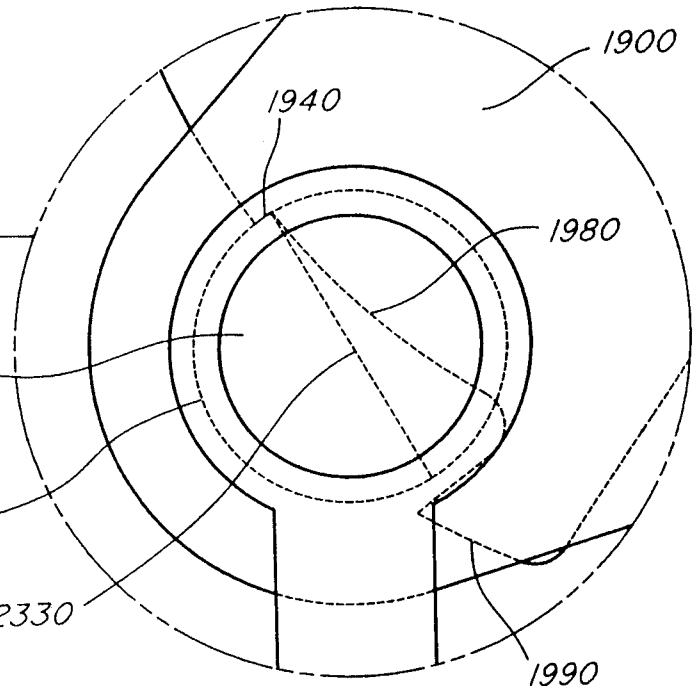
FIG. 5B is an expanded view of a portion of FIG. 5A.
Figure 5A:
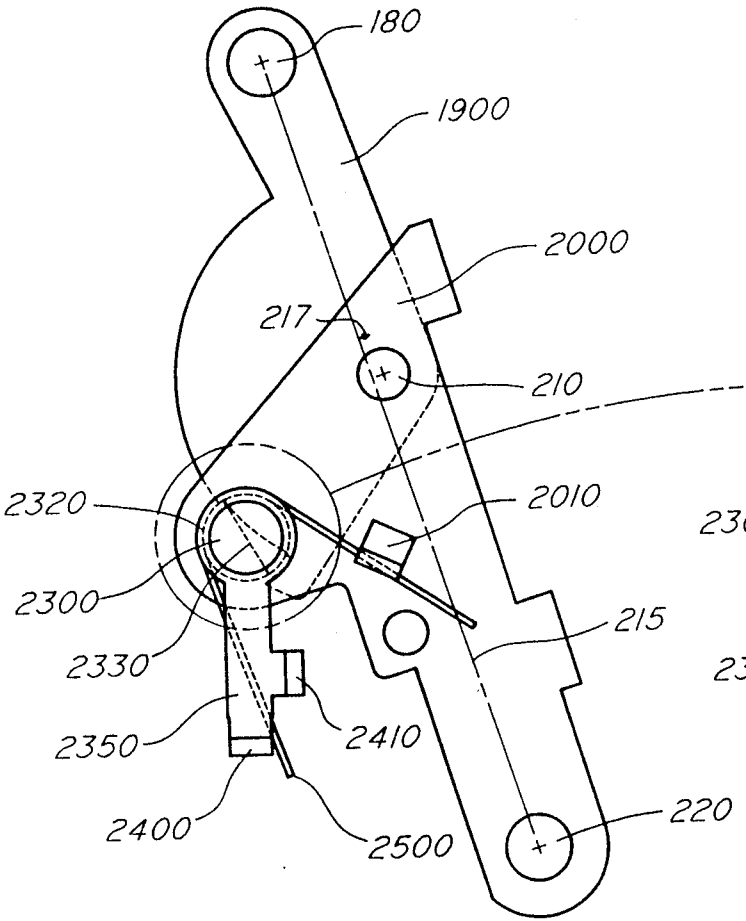
FIG. 5A depicts the toggle mechanism of the inventive single pole circuit breaker depicted in FIG. 4.

As depicted in FIGS. 4 and 5A, the inventive toggle mechanism, shown in its locked position, includes a cam link 1900 which is pivotably connected to the handle 160 via the pin 180. The toggle mechanism also includes a link housing 2000, one end of which is pivotably connected to the cam link 1900 via the rivet 210 and the other end of which is pivotably connected to the contact bar 70 via the pin 220. It should be noted that, by contrast with previous link housings, the link housing 2000 lacks a projecting arm 205 or, if one is provided, it should be positioned so as to be non-functional in limiting the pivotal motion of the sear pin.

The inventive toggle mechanism further includes a sear assembly, including a sear pin 2300 which extends through an aperture in the link housing 2000 to the cam link 1900. As shown, the sear pin 2300 includes a curved surface, preferably a semi-circular surface, 2320 intersected by a substantially planar surface 2330. The sear assembly also includes a leg 2350, connected to the sear pin 2300. A sear striker bar 2400, which is connected to the leg 2350, projects into the plane of the paper, as viewed in FIG. 5A, and is positioned so as to be in the path of the leg 265 (FIG. 1) of the armature 260. If the single pole circuit breaker 1000 is to be employed in a multipole circuit breaker, then the sear assembly preferably also includes a second sear striker bar 2410, connected to the leg 2350, which projects out of the plane of the paper (as viewed in FIG. 5A), as more fully discussed below.

A helical spring 2500, which encircles the sear pin 2300, is also provided. One end of this spring abuts a tab 2010 on the link housing 2000, while the opposite end of this spring abuts the sear striker bar 2400. By virtue of this arrangement, the spring 2500 directly pivotally biases the sear pin 2300 into engagement with the cam link 1900 (without the intervention of the projecting arm 205, as is conventional).

With reference now to FIG. 5B, the cam link 1900 includes a step in its outer profile formed by the intersection of two non-parallel surfaces 1940 and 1980. Significantly, the depth of this step, i.e., the length of the surface 1940 as viewed in cross-section in FIG. 5B, is preferably chosen to be essentially equal to the desired length of overlap with the curved surface 2320. Thus, under the influence of the pivotal biasing force exerted by the spring 2500, the substantially planar surface 2330 of the sear pin 2300 is pivoted into contact with the surface 1980 of the cam link 1900, thereby automatically and conveniently achieving the desired length of overlap between the surface 1940 of the cam link and the curved surface 2320 of the sear pin. In all cases, the length of the overlap (as viewed in FIG. 5B), expressed as a percentage of the length of the surface 1940 (as also viewed in FIG. 5B), is significantly greater than 75 percent, and usually essentially equal to 100 percent.

As shown in FIG. 5B, the surface 1980 of the cam link 1900 preferably diverges from the substantially planar surface 2330 of the sear pin 2300. In addition, the surface 1980 merges into a hook 1990, which projects from the cam link 1900 towards the sear pin 2300, partially encircles the sear pin and is capable of frictionally engaging the sear pin. Significantly, the distance from the surface 1940 to the top surface of the hook 1990, measured along a line extending between the top and the bottom of the surface 2330 (as viewed in FIG. 5B), is greater than the corresponding dimension, e.g. the diameter, of the sear pin 2300. This dimensional difference is significant because it determines the amount of clockwise rotation about the rivet 210 which the cam link undergoes before the hook 1990 frictionally engages the sear pin 2300 to stop the rotation of the cam link. This, in turn, determines the subsequent amount of counterclockwise rotation which the cam link 1900 undergoes, and therefore the supplemental eccentricity.

As noted above, the conventional processes employed in manufacturing the cam link 1900 and the sear pin 2300, e.g., conventional powder pressing and machining techniques, yield parts having relatively precise dimensions, with relatively small variability between parts. As a result, the amount of clockwise rotation, and therefore the amount of counterclockwise rotation, which the cam link undergoes about the rivet 210 is precisely controlled, with relatively small variability between different toggle mechanisms. Consequently, significantly smaller baseline eccentricities, and correspondingly smaller eccentricities, can now be employed, which leads to values of R equal to or greater than about 50, preferably equal to or greater than about 60, and more preferably equal to or greater than about 70.

By way of example, in one specific reduction to practice, which also corresponds to a preferred embodiment of the invention, the length of the imaginary line 215 (see FIG. 5A) was 1.202 inches (30.5 millimeters). In addition, the baseline eccentricity was 0.010 inches (0.25 millimeters). Moreover, the distance from the surface 1940 to the top surface of the hook 1990 was 0.132 inches (3.35 millimeters), while the diameter of the sear pin 2300 (i.e., the length of the surface 2330, as viewed in FIG. 5B) was 0.125 inches (3.17 millimeters), the corresponding dimensional difference being 0.007 inches (0.18 millimeters). Thus, the eccentricity, which is the sum of the baseline and supplemental eccentricities, was 0.017 inches 0.43 millimeters). As a consequence, the corresponding value of R was 70.7.

Figure 6:
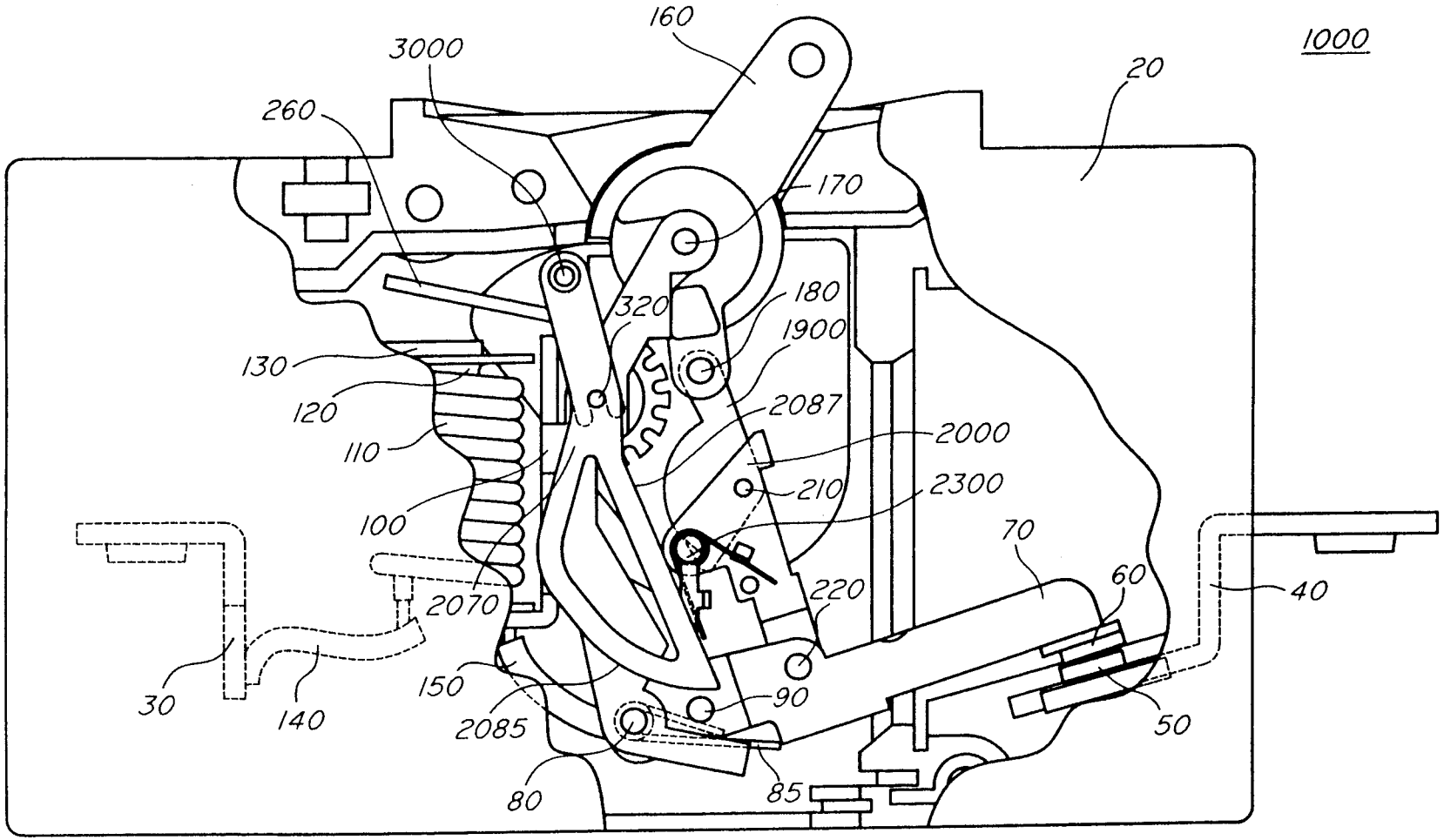
FIG. 6 is a view of the mechanism of the inventive single pole circuit breaker of FIG. 4, modified to include a new trip lever for use in a multipole circuit breaker.

With reference now to FIG. 6, when used in a multipole circuit breaker, the inventive single pole circuit breaker 1000 preferably also includes a trip lever 2070, having a camming surface 2085 engageable by the contact bar stop pin 90. As discussed in U.S. application Ser. No. 526,851 filed by Ramesh G. Nar on May 21, 1990 which is hereby incorporated by reference, this configuration permits a much larger torque to be applied to the trip lever than was previously possible. In addition, the trip lever 2085 includes a front surface 2087 which is capable of engaging the (second) sear striker bar 2410. As a result, the trip lever 2085 is capable of directly collapsing the toggle mechanism without the need to depress the armature 260.

What is claimed is:

1. A circuit breaker, comprising:

a frame;

a handle, pivotably connected to one end of said frame;

a first electrical contact which is substantially stationary relative to said frame;

a contact bar, bearing a second electrical contact, which is pivotably connected to a second end of said frame, the pivotal motion of said contact bar serving to move said second electrical contact into and out of electrical contact with said first electrical contact; and a toggle mechanism extending from said handle to said contact bar, said toggle mechanism including a cam link, pivotably connected to said handle, said cam link including a first surface having a first end and an opposite second end and intersected by a second surface, said first surface oriented substantially normal to said second surface a link housing, a first end of which is pivotably connected to said cam link and a second end of which is pivotably connected to said contact bar, and a sear pin, extending through an aperture in said link housing, said sear pin including a curved surface intersected by a substantially planar surface, a portion of said first surface of said cam link overlapping and contacting a portion of said curved surface of said sear pin when said toggle mechanism is locked, characterized in that the length of overlap between said first surface of said cam link and said curved surface of said sear pin when said toggle mechanism is locked, expressed as a percentage of a length of said first surface from said first end to said second end, is greater than about 75 percent.

2. The circuit breaker of claim 1, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

3. A circuit breaker, comprising:

a frame;

a handle, pivotably connected to one end of said frame;

a first electrical contact which is substantially stationary relative to said frame;

a contact bar, bearing a second electrical contact, which is pivotably connected to a second end of said frame, the pivotal motion of said contact bar serving to move said second electrical contact into and out of electrical contact with said first electrical contact; and a toggle mechanism extending from said handle to said contact bar, said toggle mechanism including a cam link, pivotably connected to said handle, said cam link including a first surface, intersected by a second surface, the intersection of said first and second surfaces defining a step, a link housing, a first end of which is pivotably connected to said cam link and a second end of which is pivotably connected to said contact bar, and a sear pin, extending through an aperture in said link housing, said sear pin including a curved surface intersected by a substantially planar surface, a portion of said first surface of said cam link overlapping and contacting a portion of said curved surface of said sear pin when said toggle mechanism is locked, characterized in that a length of said first surface of said cam link is chosen to be essentially equal to a desired length of overlap between said first surface and said curved surface when said toggle mechanism is locked, and said circuit breaker further includes means for biasing said substantially planar surface of said sear pin into contact with said second surface of said cam link when said toggle mechanism is locked, whereby said desired length of overlap is automatically achieved.

4. The circuit breaker of claim 3, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

5. The circuit breaker of claim 3, wherein said means includes a helical spring encircling said sear pin which pivotally biases said substantially planar surface of said sear pin into contact with said second surface of said cam link when said toggle mechanism is locked.

6. The circuit breaker of claim 5, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

7. A circuit breaker, comprising:

a frame;

a handle, pivotably connected to one end of said frame;

a first electrical contact which is substantially stationary relative to said frame;

a contact bar, bearing a second electrical contact, which is pivotably connected to a second end of said frame, the pivotal motion of said contact bar serving to move said second electrical contact into and out of electrical contact with said first electrical contact; and a toggle mechanism extending from said handle to said contact bar, said toggle mechanism including a cam link, pivotably connected to said handle via a first pin, a link housing, one end of which is pivotably connected to said cam link via a second pin and the other end of which is pivotably connected to said contact bar via a third pin, and a sear pin, extending through an aperture in said link housing, said sear pin engaging said cam link when said toggle mechanism is locked, the locked toggle mechanism being characterized by a length of an imaginary, straight line extending from the center of said first pin to the center of said third pin and by a corresponding eccentricity, characterized in that a ratio of the length of said line to said eccentricity is equal to or greater than about 50.

8. The circuit breaker of claim 7, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

9. The circuit breaker of claim 7, wherein said ratio is equal to or greater than about 60.

10. The circuit breaker of claim 9, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

11. The circuit breaker of claim 9, wherein said ratio is equal to or greater than about 70.

12. The circuit breaker of claim 11, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

13. A circuit breaker, comprising:

a frame;

a handle, pivotably connected to one end of said frame;

a first electrical contact which is substantially stationary relative to said frame;

a contact bar, bearing a second electrical contact, which is pivotably connected to a second end of said frame, the pivotal motion of said contact bar serving to move said second electrical contact into and out of electrical contact with said first electrical contact; and a toggle mechanism extending from said handle to said contact bar, said toggle mechanism including a cam link, pivotably connected to said handle, a link housing, one end of which is pivotably connected to said cam link and the other end of which is pivotably connected to said contact bar, and a sear pin, extending through an aperture in said link housing, said sear pin engaging said cam link when said toggle mechanism is locked, characterized in that said cam link includes a hook capable of frictionally engaging said sear pin to limit the rotation of said cam link about the pivotal connection to said link housing.

14. The circuit breaker of claim 13, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

15. A circuit breaker comprising:

a frame;

a handle, pivotably connected to one end of said frame;

a first electrical contact which is substantially stationary relative to said frame;

a contact bar, bearing a second electrical contact, which is pivotably connected to a second end of said frame, the pivotal motion of said contact bar serving to move said second electrical contact into and out of electrical contact with said first electrical contact; and a toggle mechanism extending from said handle to said contact bar, said toggle mechanism including a cam link, pivotably connected to said handle, said cam link including a first surface intersected by a second surface, the intersection of said first and second surfaces defining a step, a link housing, a first end of which is pitotably connected to said cam link and a second end of which is pivotably connected to said contact bar, and a sear pin, extending through an aperture in said link housing, said sear pin including a curved surface intersected by a substantially planar surface, a portion of said first surface of said cam link overlapping and contacting a portion of said curved surface of said sear pin when said toggle mechanism is locked, characterized in that the length of overlap between said first surface of said cam link and said curved surface of said sear pin when said toggle mechanism is locked, expressed as a percentage of a length of said first surface, is essentially 100 percent.

16. The circuit breaker of claim 15, wherein said substantially planar surface of said sear pin contacts said second surface of said cam link when said toggle mechanism is locked.

17. The circuit breaker of claim 16, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

18. The circuit breaker of claim 15, wherein said first electrical contact, said contact bar, and said toggle mechanism form a first circuit breaker mechanism for a first pole, and said circuit breaker further comprises a second said circuit breaker mechanism for a second pole, and a trip lever for unlocking the toggle mechanism of said second pole responsive to tripping of said first circuit breaker mechanism.

* * * * *